US008267777B2

(12) United States Patent
Jaffe

(10) Patent No.: US 8,267,777 B2
(45) Date of Patent: Sep. 18, 2012

(54) WAGERING GAME WITH PROGRESSIVE AWARD INDICATOR HAVING AN INCREMENTING FEATURE

(75) Inventor: Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 567 days.

(21) Appl. No.: 12/513,319

(22) PCT Filed: Oct. 31, 2007

(86) PCT No.: PCT/US2007/023000

§ 371 (c)(1),
(2), (4) Date: May 1, 2009

(87) PCT Pub. No.: WO2008/057356

PCT Pub. Date: May 15, 2008

(65) Prior Publication Data

US 2010/0016060 A1 Jan. 21, 2010

Related U.S. Application Data

(60) Provisional application No. 60/856,227, filed on Nov. 2, 2006.

(51) Int. Cl.
*A63F 9/24* (2006.01)

(52) U.S. Cl. ..... 463/27

(58) Field of Classification Search ..... 463/16, 463/20, 25, 27

See application file for complete search history.

(56) References Cited

U.S. PATENT DOCUMENTS

| | | | | |
|---|---|---|---|---|
| 4,624,459 | A | 11/1986 | Kaufman | 273/143 R |
| 4,837,728 | A | 6/1989 | Barrie et al. | 364/412 |
| 4,861,041 | A | 8/1989 | Jones et al. | 273/292 |
| 4,948,134 | A | 8/1990 | Suttle et al. | 273/85 |
| 5,116,055 | A | 5/1992 | Tracy | 273/138 A |
| 5,249,800 | A | 10/1993 | Hilgendorf et al. | 273/138 A |
| 5,275,400 | A | 1/1994 | Weingardt et al. | 463/12 |
| 5,280,909 | A | 1/1994 | Tracy | 273/138 A |
| 5,344,144 | A | 9/1994 | Canon | 273/138 A |
| 5,377,973 | A | 1/1995 | Jones et al. | 273/85 CP |
| 5,393,057 | A | 2/1995 | Marnell, II | 273/85 CP |
| 5,417,430 | A | 5/1995 | Breeding | 273/292 |

(Continued)

FOREIGN PATENT DOCUMENTS

CA 2 334 546 8/2001

(Continued)

OTHER PUBLICATIONS

International Search Report—PCT/US2007/023000 mailed May 22, 2008 (2 pages).

(Continued)

*Primary Examiner* — Brook Kebede
(74) *Attorney, Agent, or Firm* — Nixon Peabody LLP

(57) ABSTRACT

A gaming system for conducting a wagering game includes a wager input device, a first display, and a second display. The wager input device receives a wager. The first display displays an array of symbols that indicates a randomly selected outcome. The second display displays an amount of at least one progressive award in at least one display window. The progressive award has an integer value. At least a first incrementing marker moves about the display window in response to changes in value of the progressive award.

27 Claims, 7 Drawing Sheets

U.S. PATENT DOCUMENTS

| | | | | |
|---|---|---|---|---|
| 5,524,888 | A | 6/1996 | Heidel | 463/22 |
| 5,544,892 | A | 8/1996 | Breeding | 273/292 |
| 5,564,700 | A | 10/1996 | Celona | 463/27 |
| 5,577,959 | A | 11/1996 | Takemoto | 463/25 |
| 5,580,063 | A | 12/1996 | Edwards | 273/378 |
| 5,580,309 | A | 12/1996 | Piechowiak et al. | 463/16 |
| 5,611,730 | A | 3/1997 | Weiss | 463/20 |
| 5,645,486 | A | 7/1997 | Nagao et al. | 463/27 |
| 5,647,592 | A | 7/1997 | Gerow | 463/139 |
| 5,655,961 | A | 8/1997 | Acres et al. | 463/27 |
| 5,766,076 | A | 6/1998 | Pease et al. | 463/27 |
| RE35,864 | E | 7/1998 | Weingardt | 463/28 |
| 5,779,549 | A | 7/1998 | Walker et al. | 463/42 |
| 5,816,918 | A | 10/1998 | Kelly et al. | 463/16 |
| 5,820,459 | A | 10/1998 | Acres et al. | 463/25 |
| 5,823,874 | A | 10/1998 | Adams | 463/17 |
| 5,839,956 | A | 11/1998 | Takemoto | 463/25 |
| 5,848,932 | A | 12/1998 | Adams | 463/20 |
| 5,851,147 | A | 12/1998 | Stupak et al. | 463/13 |
| 5,855,515 | A | 1/1999 | Pease et al. | 463/27 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 5,944,606 | A | 8/1999 | Gerow | 463/27 |
| 5,951,011 | A | 9/1999 | Potter et al. | 273/292 |
| 6,003,013 | A | 12/1999 | Boushy et al. | 705/10 |
| 6,007,066 | A | 12/1999 | Moody | 273/292 |
| 6,007,427 | A | 12/1999 | Wiener et al. | 463/17 |
| 6,012,982 | A | 1/2000 | Piechowiak et al. | 463/16 |
| 6,032,955 | A | 3/2000 | Luciano et al. | 273/138.1 |
| 6,047,963 | A | 4/2000 | Pierce et al. | 273/121 B |
| 6,089,977 | A | 7/2000 | Bennett | 463/20 |
| 6,089,980 | A | 7/2000 | Gauselmann | 463/27 |
| 6,102,474 | A | 8/2000 | Daley | 296/836 |
| 6,102,799 | A | 8/2000 | Stupak | 463/27 |
| 6,110,043 | A | 8/2000 | Olsen | 463/27 |
| 6,139,013 | A | 10/2000 | Pierce et al. | 273/121 B |
| 6,142,872 | A | 11/2000 | Walker et al. | 463/16 |
| 6,146,273 | A | 11/2000 | Olsen | 463/27 |
| 6,155,925 | A | 12/2000 | Giobbi et al. | 463/20 |
| 6,158,741 | A | 12/2000 | Koelling | 273/292 |
| 6,159,097 | A | 12/2000 | Gura | 463/20 |
| 6,168,523 | B1 | 1/2001 | Piechowiak et al. | 463/26 |
| 6,190,255 | B1 | 2/2001 | Thomas et al. | 463/20 |
| 6,203,010 | B1 | 3/2001 | Jorasch et al. | 273/138.1 |
| 6,206,374 | B1 | 3/2001 | Jones | 273/292 |
| 6,206,782 | B1 | 3/2001 | Walker et al. | 463/25 |
| 6,210,275 | B1 | 4/2001 | Olsen | 463/16 |
| 6,210,277 | B1 | 4/2001 | Stefan | 463/27 |
| 6,217,448 | B1 | 4/2001 | Olsen | 463/25 |
| 6,220,593 | B1 | 4/2001 | Pierce et al. | 273/138.1 |
| 6,224,482 | B1 | 5/2001 | Bennett | 463/20 |
| 6,224,484 | B1 | 5/2001 | Okuda et al. | 463/27 |
| 6,231,445 | B1 | 5/2001 | Acres | 463/42 |
| 6,241,608 | B1 | 6/2001 | Torango | 463/27 |
| 6,254,483 | B1 | 7/2001 | Acres | 463/26 |
| 6,312,332 | B1 | 11/2001 | Walker et al. | 463/23 |
| 6,315,660 | B1 | 11/2001 | DeMar et al. | 463/16 |
| 6,319,125 | B1 | 11/2001 | Acres | 463/25 |
| 6,319,127 | B1 | 11/2001 | Walker et al. | 463/26 |
| 6,336,859 | B2 | 1/2002 | Jones et al. | 463/13 |
| 6,336,862 | B1 | 1/2002 | Byrne | 463/27 |
| 6,345,824 | B1 | 2/2002 | Selitzky | 273/292 |
| 6,347,996 | B1 | 2/2002 | Gilmore et al. | 463/17 |
| 6,358,149 | B1 | 3/2002 | Schneider et al. | 463/27 |
| 6,361,441 | B1 | 3/2002 | Walker et al. | 463/42 |
| 6,364,768 | B1 | 4/2002 | Acres et al. | 463/25 |
| 6,375,567 | B1 | 4/2002 | Acres | 463/25 |
| 6,375,568 | B1 | 4/2002 | Roffman et al. | 463/26 |
| 6,416,409 | B1 | 7/2002 | Jordan | 463/27 |
| 6,431,983 | B2 | 8/2002 | Acres | 463/25 |
| 6,435,968 | B1 | 8/2002 | Torango | 463/27 |
| 6,439,995 | B1 | 8/2002 | Hughs-Baird et al. | 463/20 |
| 6,482,089 | B2 | 11/2002 | DeMar et al. | 463/20 |
| 6,506,117 | B2 | 1/2003 | DeMar et al. | 463/20 |
| 6,508,707 | B2 | 1/2003 | DeMar et al. | 463/16 |
| 6,517,433 | B2 | 2/2003 | Loose et al. | 463/20 |
| 6,520,855 | B2 | 2/2003 | DeMar et al. | 463/20 |
| 6,577,733 | B1 | 6/2003 | Charrin | 380/251 |
| 6,589,115 | B2 | 7/2003 | Walker et al. | 463/25 |
| 6,592,458 | B1 | 7/2003 | Ho | 463/17 |
| 6,592,460 | B2 | 7/2003 | Torango | 463/27 |
| 6,599,186 | B1 | 7/2003 | Walker et al. | 463/17 |
| 6,599,188 | B2 | 7/2003 | Hirsch et al. | 463/19 |
| 6,599,193 | B2 | 7/2003 | Baerlocher et al. | 463/27 |
| 6,601,771 | B2 | 8/2003 | Charrin | 235/492 |
| 6,609,973 | B1 | 8/2003 | Weiss | 463/20 |
| 6,648,762 | B2 | 11/2003 | Walker et al. | 463/25 |
| 6,656,052 | B2 | 12/2003 | Abramopoulos et al. | 463/47 |
| 6,676,513 | B2 | 1/2004 | Gauselmann | 463/20 |
| 6,712,694 | B1 | 3/2004 | Nordman | 463/20 |
| 6,712,695 | B2 | 3/2004 | Mothwurf et al. | 463/25 |
| 6,733,390 | B2 | 5/2004 | Walker et al. | 463/23 |
| 6,776,715 | B2 | 8/2004 | Price | 463/27 |
| 6,887,154 | B1 | 5/2005 | Luciano, Jr. et al. | 463/26 |
| 6,929,264 | B2 | 8/2005 | Huard et al. | 273/274 |
| 7,004,466 | B2 | 2/2006 | Gauselmann | 463/138 |
| 7,036,012 | B2 | 4/2006 | Charrin | 713/169 |
| 7,056,215 | B1 | 6/2006 | Olive | 463/27 |
| 2001/0004607 | A1 | 6/2001 | Olsen | 463/26 |
| 2002/0138594 | A1 | 9/2002 | Rowe | 709/219 |
| 2002/0151345 | A1 | 10/2002 | Byrne | 463/18 |
| 2002/0155874 | A1 | 10/2002 | Byrne | 463/16 |
| 2003/0014370 | A1 | 1/2003 | Charrin | 705/65 |
| 2003/0027618 | A1 | 2/2003 | Byrne | 463/16 |
| 2003/0027625 | A1 | 2/2003 | Rowe | 463/20 |
| 2003/0036430 | A1 | 2/2003 | Cannon | 463/42 |
| 2003/0045337 | A1 | 3/2003 | Byrne | 463/16 |
| 2003/0050106 | A1 | 3/2003 | Lyfoung | 463/13 |
| 2003/0060266 | A1 | 3/2003 | Baerlocher | 463/20 |
| 2003/0064776 | A1 | 4/2003 | Byrne | 463/16 |
| 2003/0064805 | A1 | 4/2003 | Wells | 463/39 |
| 2003/0109306 | A1 | 6/2003 | Karmarkar | 463/40 |
| 2003/0125102 | A1 | 7/2003 | Cannon | 463/20 |
| 2003/0148807 | A1 | 8/2003 | Acres | 463/40 |
| 2003/0148808 | A1 | 8/2003 | Price | 463/27 |
| 2003/0181231 | A1 | 9/2003 | Vancura et al. | 463/9 |
| 2003/0186733 | A1 | 10/2003 | Wolf et al. | 463/16 |
| 2003/0211884 | A1 | 11/2003 | Gauselmann | 463/20 |
| 2003/0216166 | A1* | 11/2003 | Baerlocher et al. | 463/20 |
| 2003/0222402 | A1 | 12/2003 | Olive | 273/292 |
| 2003/0228899 | A1 | 12/2003 | Evans | 463/25 |
| 2003/0236116 | A1 | 12/2003 | Marks et al. | 463/16 |
| 2004/0002376 | A1 | 1/2004 | Swift et al. | 463/25 |
| 2004/0009808 | A1 | 1/2004 | Gauselmann | 463/25 |
| 2004/0009811 | A1 | 1/2004 | Torango | 463/25 |
| 2004/0023716 | A1 | 2/2004 | Gauselmann | 463/23 |
| 2004/0038741 | A1 | 2/2004 | Gauselmann | 463/42 |
| 2004/0048644 | A1 | 3/2004 | Gerrard et al. | 463/16 |
| 2004/0048646 | A1 | 3/2004 | Visocnik | 463/16 |
| 2004/0048649 | A1 | 3/2004 | Peterson et al. | 463/20 |
| 2004/0053666 | A1 | 3/2004 | Vancura | 463/16 |
| 2004/0092304 | A1 | 5/2004 | George | 463/29 |
| 2005/0003880 | A1 | 1/2005 | Englman | 463/16 |
| 2005/0055113 | A1 | 3/2005 | Gauselmann | 700/91 |
| 2005/0059467 | A1 | 3/2005 | Saffari et al. | 463/19 |
| 2005/0059472 | A1 | 3/2005 | Joshi et al. | 463/20 |
| 2005/0064930 | A1 | 3/2005 | Jubinville et al. | 463/17 |
| 2005/0096130 | A1 | 5/2005 | Mullins | 463/27 |
| 2005/0130731 | A1 | 6/2005 | Englman et al. | 463/20 |
| 2005/0137010 | A1 | 6/2005 | Enzminger et al. | 463/25 |
| 2005/0192088 | A1 | 9/2005 | Hartman et al. | 463/27 |
| 2005/0215313 | A1 | 9/2005 | O'Halloran | 463/26 |
| 2005/0239542 | A1 | 10/2005 | Olsen | 463/27 |
| 2006/0003829 | A1* | 1/2006 | Thomas | 463/20 |
| 2006/0019737 | A1 | 1/2006 | Yang | 463/19 |
| 2006/0025195 | A1 | 2/2006 | Pennington et al. | 463/16 |
| 2006/0025210 | A1 | 2/2006 | Johnson | 463/25 |
| 2006/0030403 | A1 | 2/2006 | Lafky et al. | 463/27 |
| 2006/0035706 | A1* | 2/2006 | Thomas et al. | 463/27 |
| 2006/0052159 | A1 | 3/2006 | Cahill et al. | 463/27 |
| 2006/0073887 | A1 | 4/2006 | Nguyen et al. | 463/20 |
| 2006/0073889 | A1 | 4/2006 | Edidin et al. | 463/27 |
| 2006/0116201 | A1 | 6/2006 | Gauselmann | 463/26 |
| 2006/0142079 | A1 | 6/2006 | Ikehara et al. | 463/27 |
| 2006/0142086 | A1 | 6/2006 | Blackburn et al. | 463/42 |
| 2006/0154718 | A1 | 7/2006 | Willyard et al. | 463/25 |

| | | | | |
|---|---|---|---|---|
| 2006/0178203 | A1 | 8/2006 | Hughes et al. | 463/20 |
| 2006/0183535 | A1 | 8/2006 | Marks et al. | 463/20 |
| 2006/0183537 | A1 | 8/2006 | Dickerson | 463/27 |
| 2006/0183538 | A1 | 8/2006 | Michaelson et al. | 463/27 |
| 2006/0281527 | A1 | 12/2006 | Dunaevsky et al. | 463/20 |
| 2006/0287077 | A1 | 12/2006 | Grav et al. | 463/27 |
| 2007/0026941 | A1 | 2/2007 | Block et al. | 463/29 |
| 2007/0054733 | A1 | 3/2007 | Baerlocher | 463/27 |
| 2007/0060244 | A1 | 3/2007 | Yaldoo et al. | 463/16 |
| 2007/0060271 | A1 | 3/2007 | Cregan et al. | 463/16 |
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |
| 2007/0213114 | A1 | 9/2007 | Caspers et al. | 463/16 |

FOREIGN PATENT DOCUMENTS

| | | | |
|---|---|---|---|
| DE | 195 15 983 | A1 | 11/1996 |
| DE | 196 24 321 | A1 | 1/1998 |
| EP | 0 521 599 | A1 | 1/1993 |
| GB | 2 153 572 | A | 8/1985 |
| GB | 2 181 589 | A | 4/1987 |
| GB | 2 242 300 | A | 9/1991 |
| GB | 2 313 792 | A | 10/1997 |
| GB | 2 333 880 | A | 8/1999 |
| WO | WO 99/03078 | A1 | 1/1999 |
| WO | WO 99/19037 | A1 | 4/1999 |
| WO | WO 01/33478 | A1 | 5/2001 |
| WO | WO 03/026754 | A1 | 4/2003 |
| WO | WO 03/083789 | A1 | 10/2003 |
| WO | WO 2005/099425 | A2 | 10/2005 |
| WO | WO 2006/039349 | A2 | 4/2006 |
| WO | WO 2009/032150 | A1 | 3/2009 |

OTHER PUBLICATIONS

International Written Opinion—PCT/US2007/023000 mailed May 22, 2008 (6 pages).

Article for "Easy Riches" by Sigma Game, Strictly Slots, 1 page (Aug. 2001).

Article for "Millioniser" by Glenn Haussman, Strictly Slots, pp. 50-53, 4 pages (Mar. 2004).

Product Sheet for "Big Games Safari," IGT, 24 pages (2000).

"New '97 Games," International Gaming & Wagering Business, 23 pages (Mar. 1997).

PCT International Search Report for International Application No. PCT/US2005/08951 dated Nov. 16, 2005 (3 pages).

* cited by examiner

WAGERING GAME WITH PROGRESSIVE AWARD INDICATOR HAVING AN INCREMENTING FEATURE

CROSS-REFERENCE TO RELATED APPLICATIONS

This application is a U.S. national stage of International Application No. PCT/US2007/023000, filed Oct. 31, 2007, which is related to and claims the benefit of U.S. Provisional Application No. 60/856,227, filed Nov. 2, 2006, each of which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to gaming machines displaying different ways of representing the incrementing of a progressive award amount.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive award" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators. One type of bonus game may award a progressive award in the form of free spins on the basic game. As only integer values of free spins may be awarded, it is difficult to allow a player to observe the rate of increase in a bonus award, as no decimals are displayed. Therefore, it would be desirable to allow a user to graphically observe the incrementing of a bonus award.

SUMMARY OF THE INVENTION

According to one aspect of the present invention, a gaming system for conducting a wagering game includes a wager input device, a first display, and a second display. The wager input device receives a wager. The first display displays an array of symbols that indicates a randomly selected outcome. The second display displays an amount of at least one progressive award in at least one display window. The progressive award has an integer value. At least a first incrementing marker moves about the display window in response to changes in value of the progressive award.

According to another aspect of the invention, a method of conducting a wagering game on a gaming system comprises receiving a wager, generating an outcome in the wagering game and displaying, funding a progressive award, displaying the progressive award, and depicting changes to the progressive award. The changes to the progressive award are depicted by at least one incrementing marker moving about a display window.

According to yet another aspect of the invention, a method of displaying a progressive award of a wagering game comprises displaying at least one progressive award using an integer in a display. Changes to the progressive award are depicted using at least one incrementing marker that moves about the display window. The incrementing marker moves at least one complete rotation about the display window to increment the integer by a single unit.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
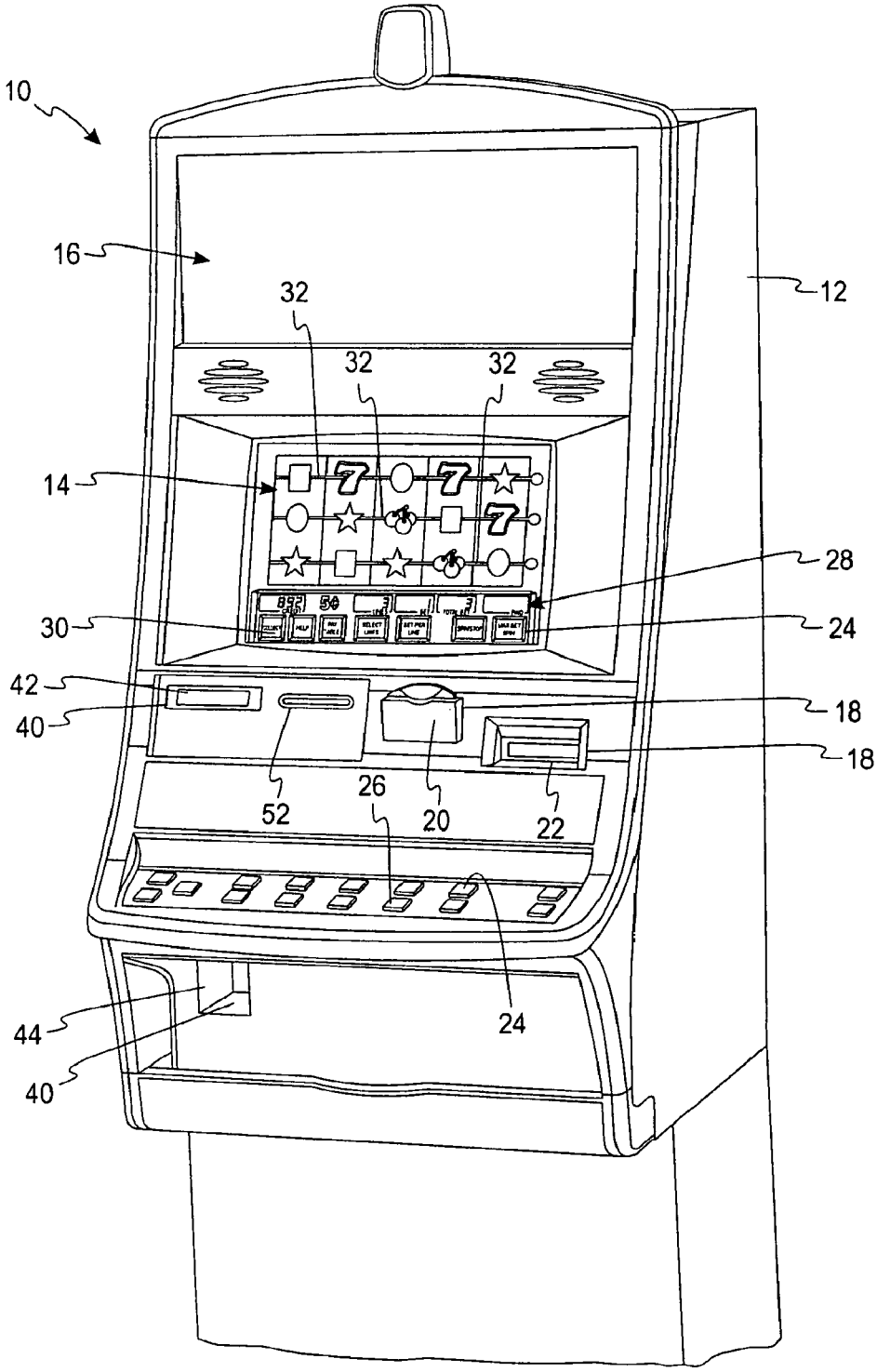
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
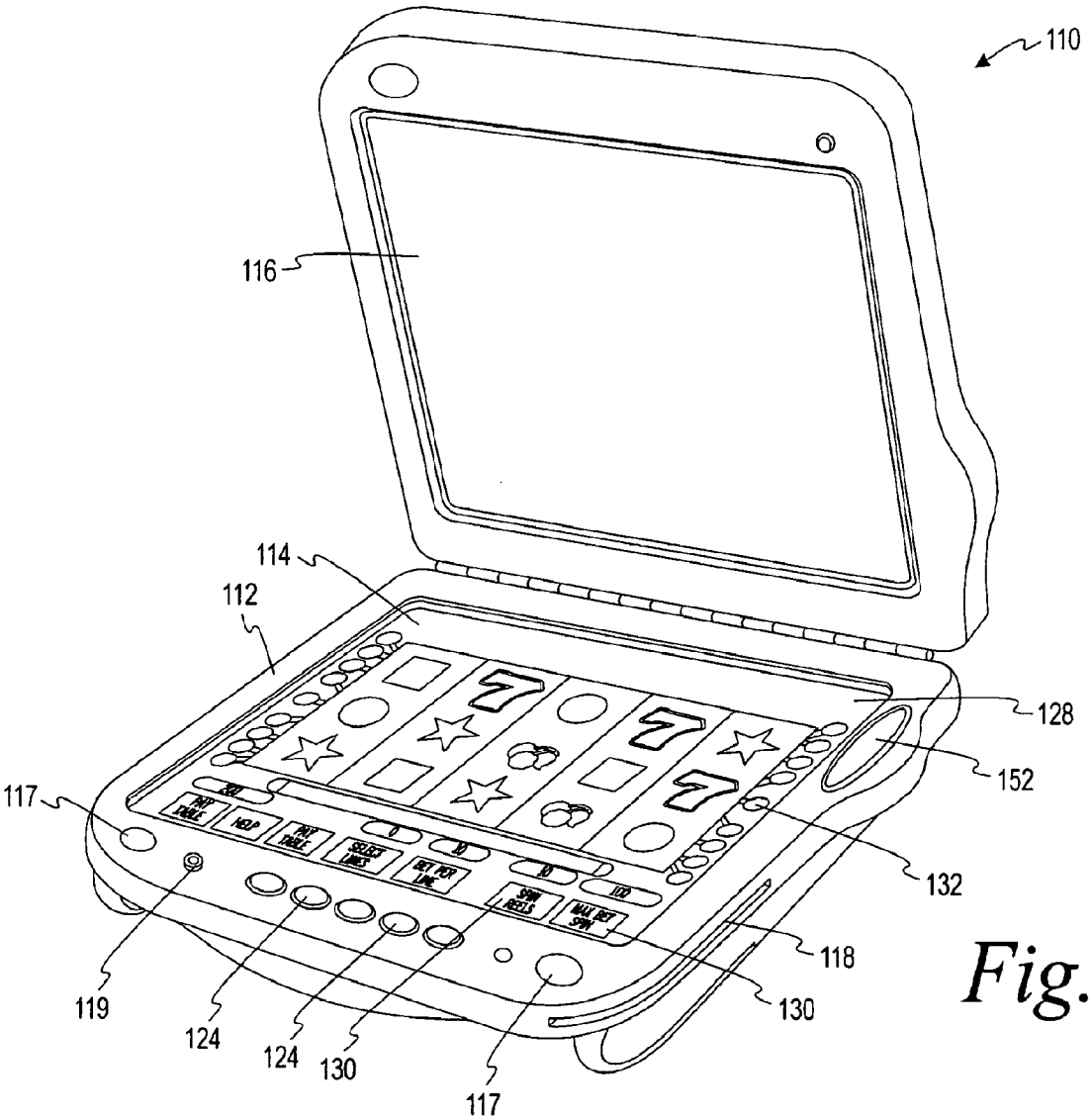
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
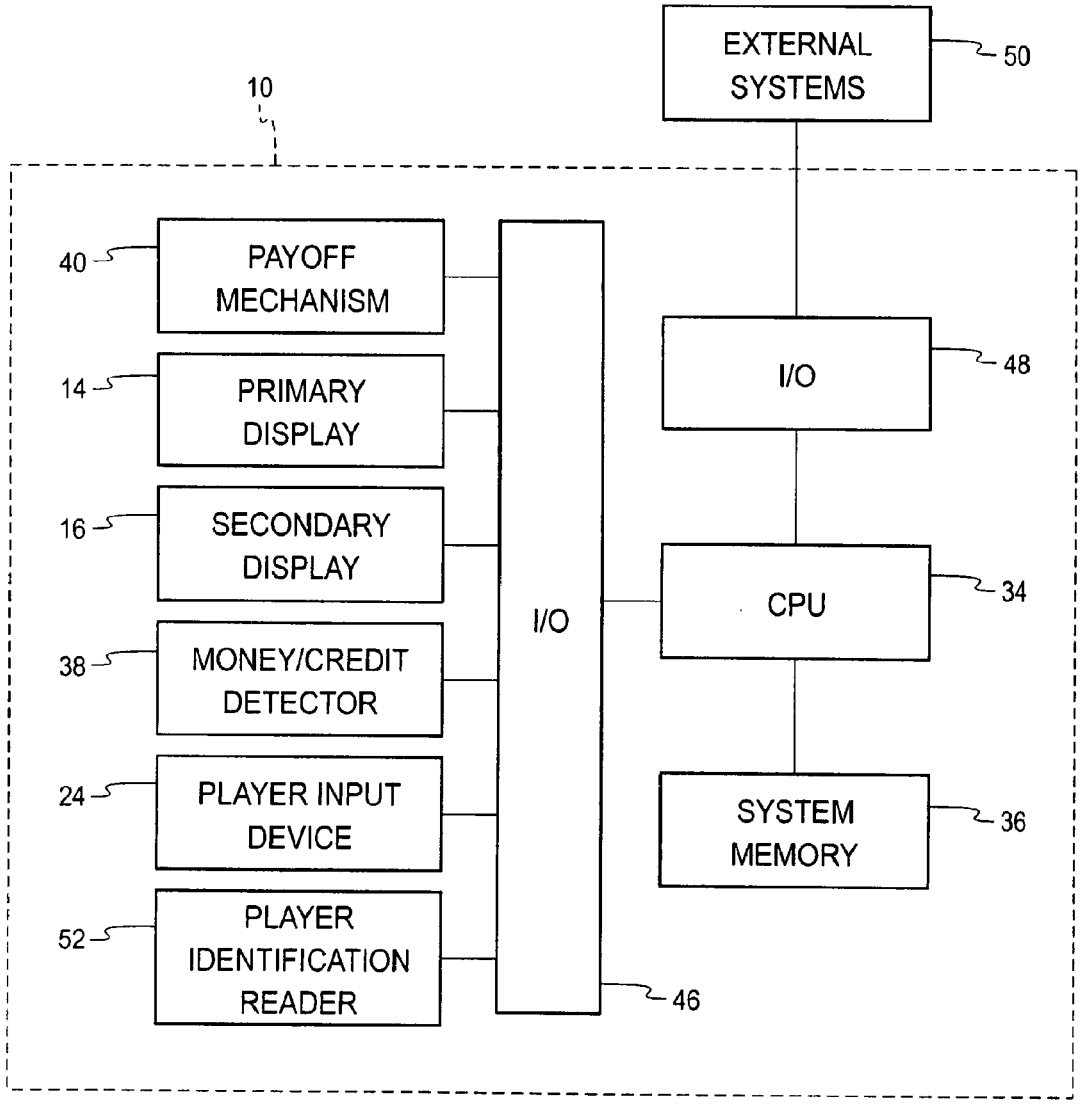
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10, 110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10, 110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
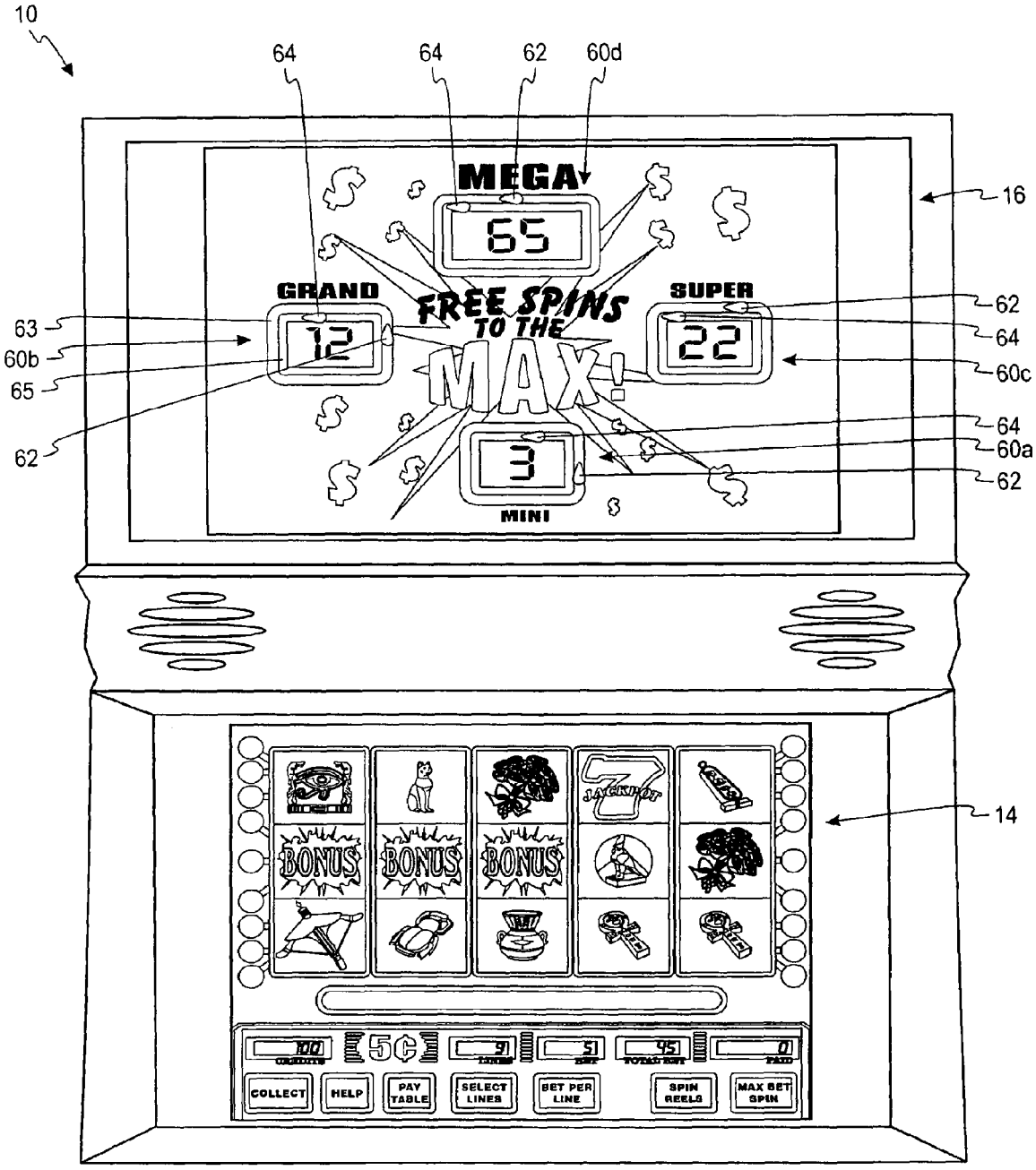
FIG. 3 is a front view of a gaming machine showing a main display with a plurality of spinning reels and a secondary display including a dynamic representation of a progressive award.

Turning now to FIG. 3, the secondary display 16 includes a plurality of display windows 60*a*-60*d* for progressive awards. The display windows 60*a*-60*d*, shown displaying a number of free spins, are updated in real-time according to changes occurring in the corresponding progressive awards. Specifically, the number displayed in the display windows 60*a*-60*d* increases or decreases as the amount of the corresponding progressive award increases or decreases. As the secondary display 16 in the embodiment in FIG. 3 shows a progressive award that consists of a number of free spins, the number shown in the display windows 60*a*-60*d* will be an integer. The same features may be implemented in combination with other displays including, but not limited to, an area display.

After a game outcome has been selected in the main display 14, a percentage of the player's wager is added to the progressive awards. As shown in FIG. 3, the progressive awards are in the form of free spins, thus, the percentage of the player's wager is added to the progressive awards in the form of portions of a free spin. Thus, before or after the array of symbols are shown on the primary display 14, a percentage of the player's wager is added to the progressive award regardless of whether the displayed symbols form a winning combination.

In at least some aspects, the display windows 60*a*-60*d* each include a first incrementing marker 62 within a first path 63 and a second incrementing marker 64 within a second path 65. As shown in FIG. 3, the first path 63 and the second path 65 are shown at a periphery of the display windows 60*a*-60*d*. The second path 65 is located nearest the display windows 60*a*-60*d*, and the first path 63 is located outside of the second path 65. The first path 63 and the second path 65 are concentric. The first incrementing marker 62 is adapted to rotate about a display window, e.g., display window 60*c*, to indicate a one-hundredths decimal value (0.0X) for the integer displayed within the display window. Thus, for every one hundred complete rotations that the first incrementing marker 62 makes about the display window 60*c*, the number shown within the display window 60*c* will increase by a single integer, e.g., from 22 to 23.

Similarly, the second incrementing marker 64 is adapted to rotate about a display window, e.g., display window 60*c*, to indicate when a tenths decimal value (0.X0) for the integer displayed within the display window. Thus, for every ten complete rotations the first incrementing marker 62 makes about the display window 60*c*, the integer number shown within the display window 60*c* will increase by a single integer, e.g., from 22 to 23.

As the added percentage of credits is added to progressive awards shown in the display windows 60*a*-60*d*, the first marker 62 rotates about the respective display window. After the first marker 62 has made a complete rotation a decimal value, that is not shown to the player, of the integer number shown in the respective display window has increased by one one-hundredth. The second marker 64 is also rotating about the respective display window, but at a slower pace than the first marker 62. Once the first marker 62 has made ten complete rotations about the display window, the second marker 64 will have made one complete rotation about the display window, and the decimal value, that is not shown to the player, of the integer number shown in the display window is incremented by one tenth.

Therefore, the rotation of the first incrementing marker 62 and the second incrementing marker 64 allow the player to observe the rate that the progressive awards are increasing.

It is contemplated according to an alternative embodiment that a first incrementing marker represents a one-hundredths decimal value of an integer shown in a display window makes ten complete rotations about the display window and a second incrementing marker that represents a tenths decimal value of the integer shown in the display window makes one complete rotation about the display window prior to the number shown in the display window incrementing by a single integer.

Alternatively, a single incrementing marker disposed in a single path disposed in visual association with a display window (e.g., display window 60*a*-60*d*) on the secondary display 16 or on another display may show a player the incrementing of the bonus award.

Figure 4A:
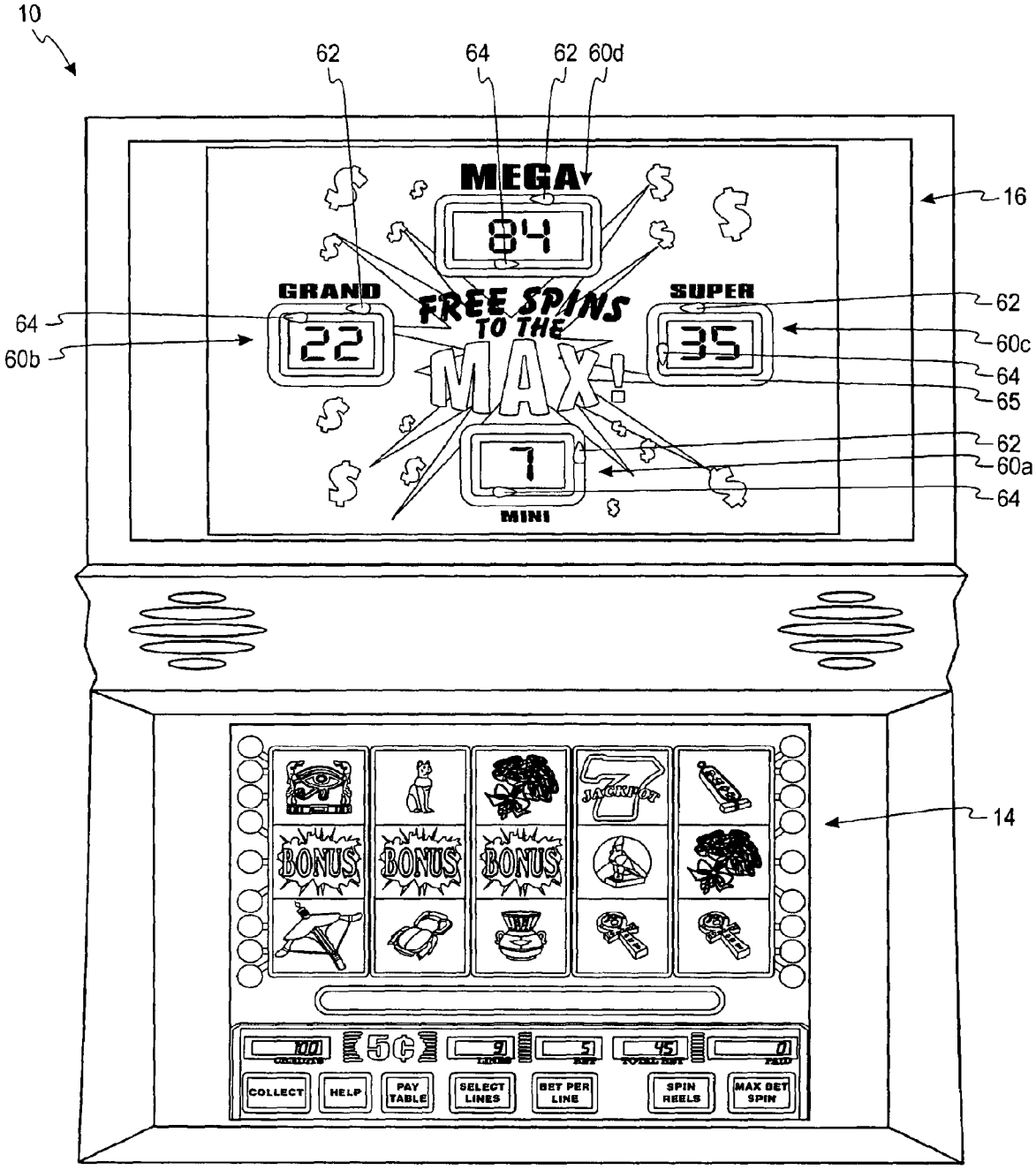
FIGS. 4*a*-4*c* illustrate the displays of FIG. 3, wherein the dynamic representation of the progressive award has increased.
Figure 4B:
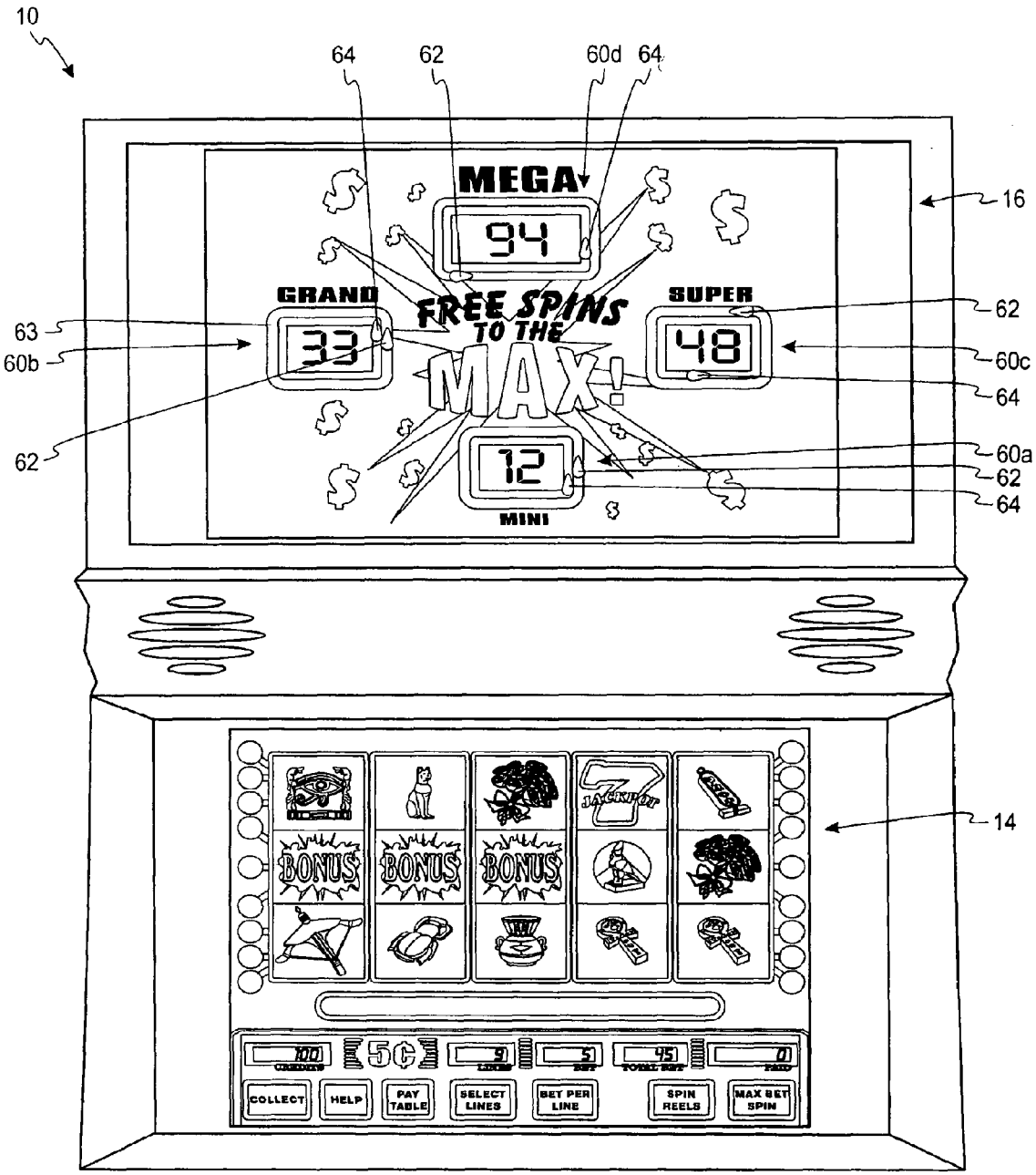
Figure 4C:
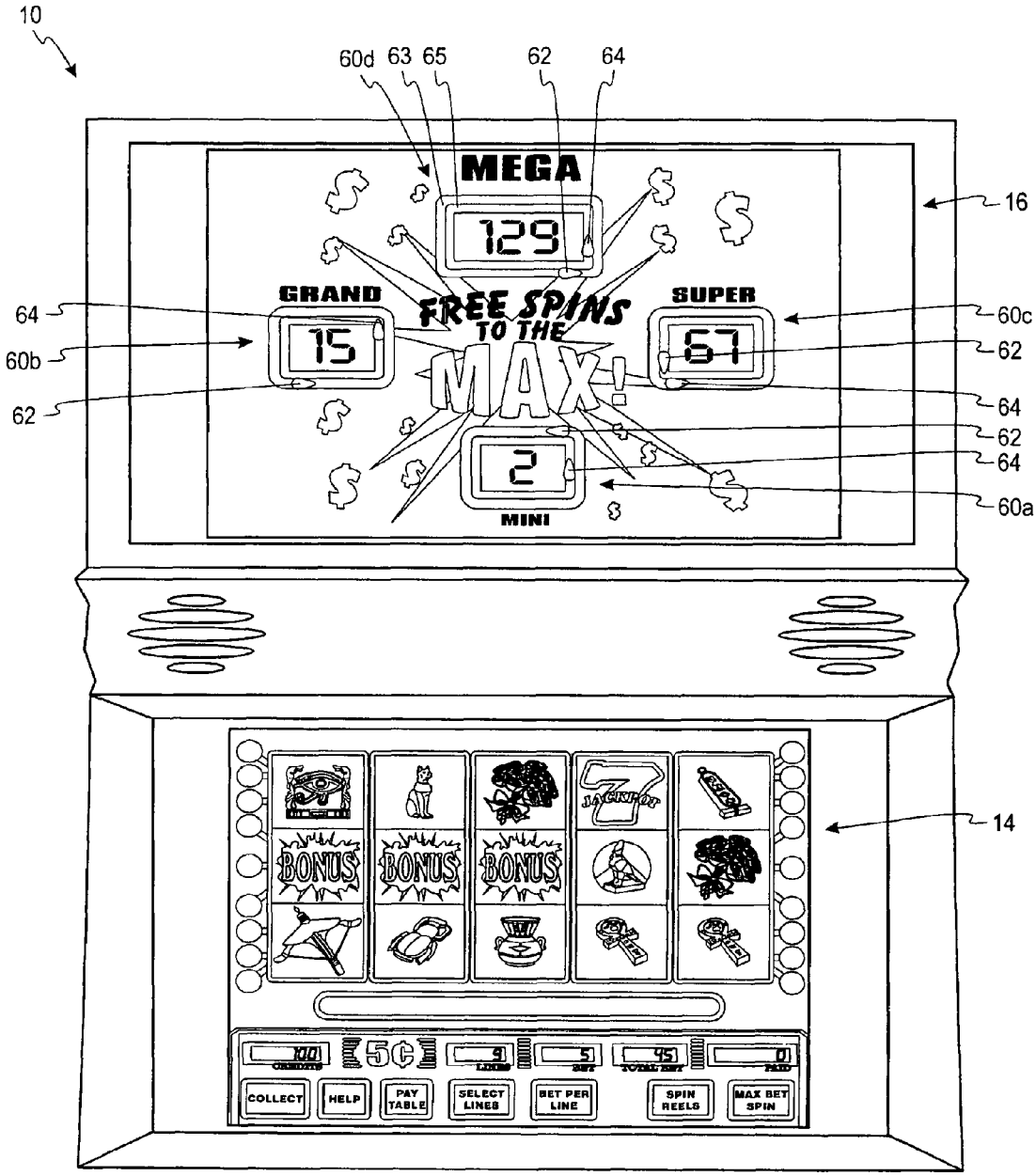

Turning now to FIGS. 4*a*-4*c* the secondary display 16 of the gaming machine 10 of FIG. 3 are shown over a period of time, the first display window 60*a* of the four display windows is adapted to display a first progressive award. The second display window 60*b* is adapted to display a second progressive award. The third display window 60*c* is adapted to show a third progressive award. The fourth display window 60*d* is adapted to show a fourth progressive award. As shown in FIGS. 4*a*-4*c*, the value of the progressive awards generally increase from the first progressive award to the fourth progressive award. FIG. 4*a* shows the secondary display 16 with the display windows 60*a*-60*d* showing a first value for each of the progressive awards, and the first markers 62 and the second markers 64 in a first position.

As shown in FIG. 4*a*, the secondary display 16 is shown at a first time with the first display window 60*a* shows the number seven (7) as the award value for a first progressive. The first marker 62 of the first display window 60*a* is in a first position, while the second marker 64 of the first display window 60*a* is in a second position. The second display window 60*b* shows the number twenty-two (22) as the award value for a second progressive. The first marker 62 of the second display window 60*b* is in a third position, while the second marker 64 of the second display window 60*b* is in a fourth position. The third display window 60*c* shows the number thirty-five (35) as the award value for a third progressive. The first marker 62 of the third display window 60*c* is in a fifth position, while the second marker 64 of the third display window 60*c* is in a sixth position. Finally, the fourth display window 60*d* shows the number eighty-four (84) as the award value for a fourth progressive. The first marker 62 of the fourth display window 60*d* is in a seventh position, while the second marker 64 of the fourth display window 60*d* is in an eighth position.

Turning next to FIG. 4*b*, the secondary display 16 is shown at a second time after the first time with the first display window 60*a* shows the number twelve (12) as the award value for the first progressive. The first marker 62 of the first display window 60*a* is in a first position, while the second marker 64 of the first display window 60*a* is in a second position. The second display window 60*b* shows the number thirty-three (33) as the award value for a second progressive. The first marker 62 of the second display window 60*b* is in a third position, while the second marker 64 of the second display window 60*b* is in a fourth position. The third display window 60*c* shows the number forty-eight (48) as the award value for a third progressive. The first marker 62 of the third display window 60*c* is in a fifth position, while the second marker 64 of the third display window 60*c* is in a sixth position. Finally, the fourth display window 60*d* shows the number ninety-four (94) as the award value for a fourth progressive. The first marker 62 of the fourth display window 60*d* is in a seventh position, while the second marker 64 of the fourth display window 60*d* is in an eighth position. The award value for the first, second, third, and fourth progressives indicated in the display windows 60*a*-60*d* at the second time represented in FIG. 4*b* are all larger than the award value for the first, second, third, and fourth progressives at the first time represented in FIG. 4*a*.

Referring next to FIG. 4*c*, the secondary display 16 is shown at a third time, after the second time represented in FIG. 4*b*, with the first display window 60*a* showing the number two (2) as the award value for the first progressive. The first marker 62 of the first display window 60*a* is in a first position, while the second marker 64 of the first display window 60*a* is in a second position. The second display window 60*b* shows the number fifteen (15) as the award value for a second progressive. The first marker 62 of the second display window 60*b* is in a third position, while the second marker 64 of the second display window 60*b* is in a fourth position. The third display window 60*c* shows the number sixty-seven (67) as the award value for a third progressive. The first marker 62 of the third display window 60*c* is in a fifth position, while the second marker 64 of the third display window 60*c* is in a sixth position. Finally, the fourth display window 60*d* shows the number one-hundred twenty-nine (129) as the award value for a fourth progressive. The first marker 62 of the fourth display window 60*d* is in a seventh position, while the second marker 64 of the fourth display window 60*d* is in an eighth position. The award value for the first and second progressives indicated in the first and second display windows 60*a*, 60*b* at the third time are smaller than the award value for the first and second progressives at the second time. This indicates that the first progressive and the second progressive have each been awarded at least once since the second time. The award value for the third and fourth progressives indicated in the third and fourth display windows 60*c*, 60*d* at the third time are both larger than the ward value for the third fourth progressives at the second time. This indicates that the third progressive and the fourth progressive have not been awarded since the second time.

It is contemplated according to one embodiment that both the first incrementing marker and the second incrementing marker are continuously moving, but the rate of movement varies with the amount of wagering occurring on the progressive game.

It is contemplated according to another embodiment that both the first incrementing marker and the second incrementing marker move in discrete increments based on the amount of wagering occurring on the progressive game.

It is contemplated that the first incrementing marker and the second incrementing marker reset to a specified position when a progressive game award is made.

It is further contemplated that the path of the incrementing markers may comprise a light that advances to fill the path. Thus, the path may begin in an unlighted state, and the path then lights as the integer shown in a display window is closer to changing. Thus, immediately prior to the integer changing, the entire path is light.

Another example of the aforementioned path is that the path may change color or hue from a darker or cooler color (e.g., blue/green) to a brighter of hotter color (e.g., red/yellow) as the turnover for a display window approaches the next integer.

It is contemplated according to an additional embodiment that the first incrementing marker and the second incrementing marker continue moving from a location along the respective first path and the second path when a progressive game award is made.

Each of these embodiments and obvious variations thereof is contemplated as falling within the spirit and scope of the claimed invention, which is set forth in the following claims.

What is claimed is:

1. A gaming system comprising:

a wager input device for receiving a wager;

a first display for displaying an array of symbols indicating a randomly selected outcome; and a second display for displaying an amount of at least one progressive award, the second display having at least one display window for showing a unit value of the at least one progressive award, wherein at least a first incrementing marker moves about a periphery of the display window along a first predefined path in response to changes in fractions of the unit value of the at least one progressive award.

2. The gaming system of claim 1, wherein the at least one display window has a second incrementing marker that moves about the periphery of the display window along a second predefined path that is concentric with the first predefined path.

3. The gaming system of claim 2, wherein the unit value is an integer and the first incrementing marker indicates a value of a first decimal digit of the progressive award and the second incrementing marker indicates a value of a second decimal digit of the progressive award.

4. The gaming system of claim 3, wherein the first incrementing marker and the second incrementing marker move in a same direction about the display window.

5. The gaming system of claim 3, wherein the first incrementing marker and the second incrementing marker move in opposite directions about the display window.

6. The gaming system of claim 1, wherein the first incrementing marker has a default position upon the awarding of the at least one progressive award.

7. The gaming system of claim 1, wherein the first incrementing marker continues to increment after the awarding of the at least one progressive award.

8. The gaming system of claim 1, wherein the at least one progressive award includes a first progressive award and a second progressive award, the second display having at least a second display window for showing a unit value of the second progressive award, wherein at least a second incrementing marker moves about a second periphery the second display window along a second predefined path, the incrementing marker representing fractional changes occurring in the unit value of the second progressive award.

9. The gaming system of claim 1, wherein the progressive award comprises a number of free spins on the gaming system.

10. The gaming system of claim 1, wherein the first incrementing marker includes a light that advances to fill the first predefined path.

11. The gaming system of claim 10, wherein the first predefined path is substantially lit immediately prior to the awarding of the at least one progressive award.

12. The gaming system of claim 11, wherein the substantially lit first predefined path changes color or hue immediately prior to the awarding of the at least one progressive award.

13. A method of displaying a progressive award of a wagering game played via a gaming system, the gaming system including a wager input device and a display device, the method comprising:

displaying at least one progressive award to a player using a unit value, the progressive award being displayed in at least one display window of the display device; and depicting, on the display device, changes to the progressive award with at least one incrementing marker, the incrementing marker moving about a first periphery of the at least one display window along a first predefined path in accordance with fractional changes to the unit value of the progressive award, the incrementing marker moving at least one complete rotation about the display window to increment the unit value by a single unit.

14. The method of claim 13, wherein the at least one display window has a second incrementing marker that moves about the periphery of the display window along a second predefined path that is concentric with the first predefined path, the unit value being an integer and the first incrementing marker indicating a value of a first decimal digit of the progressive award and the second incrementing marker indicating a value of a second decimal digit of the progressive award.

15. The method of claim 14, wherein the second incrementing marker moves about the periphery of the display window ten times for each time the first indicating marker moves about the periphery of the display window.

16. A method of conducting a wagering game on a gaming system, the wagering game including a game sequence in which a player provides an input and a wagering game outcome is determined, the method comprising the acts of:

accepting a player input via a user input device, the player input indicative of a wager to play the wagering game;

interpreting the wager via one or more processors, the wager stored in one or more memory devices;

initiating the game sequence of the wagering game via at least one of the processors; and using at least one of the processors to generate an outcome in the wagering game;

fund a progressive award from a portion of the wager input; and cause at least one display device to display in a first display window a representation of the at least one progressive award such that changes to the progressive award are depicted with at least one incrementing marker, the incrementing marker moving about a first periphery of the first display window along a first predefined path in accordance to changes in the progressive award, the incrementing marker including a light that advances to fill the predefined path, wherein the changes to the progressive award are depicted by the incrementing marker moving at least one complete rotation about the first periphery of the first display window to increment a single unit of the progressive award, the first predefined path further being substantially lit and changing color or hue immediately prior to the change to the progressive award by the single unit.

17. The method of claim 16, wherein the representation of the single unit of the progressive award is in the form of an integer.

18. The method of claim 17, wherein the first display window has a second incrementing marker that moves about the first periphery of the first display window along a second predefined path, the first incrementing marker indicating a value of a first decimal digit of the progressive award displayed and the second incrementing marker indicating a value of a second decimal digit of the progressive award displayed.

19. The method of claim 18, wherein the second incrementing marker moves about the first periphery of the first display window at least ten times for each time the first incrementing marker moves about the first display window.

20. The method of claim 16, wherein the incrementing marker moves a discrete amount about the first periphery of the first display window based on the player input indicative of the wager.

21. The method of claim 16, wherein the incrementing marker continuously moves about the first periphery of the first display window based on the player input indicative of the wager.

22. The method of claim 16, wherein the incrementing marker moves to a default position about the first periphery of the first display window when the at least one progressive award is won.

23. The method of claim 16, wherein the incrementing marker continues moving about the first periphery of the first display window when the at least one progressive award is won.

24. The method of claim 16, further comprising using at least one of the processors to cause the first display device or a second display device to display a second display window, wherein the at least one progressive award includes a first progressive award and a second progressive award, the second display window displaying a representation of the second progressive award, wherein at least a second incrementing marker moves about a second periphery of the second display window along a second predefined path, the second incrementing marker representing fractional changes occurring to the second progressive award.

25. The method of claim 18, wherein the first incrementing marker and the second incrementing marker move about the first periphery of the first display window in a clockwise direction.

26. The method of claim 18, wherein the first incrementing marker and the second incrementing marker move about the first periphery of the first display window in a counterclockwise direction.

27. The method of claim 18, wherein the first incrementing marker and the second incrementing marker move about the first periphery of the first display window in opposite directions.

* * * * *